US005331939A

United States Patent [19]

Trombley et al.

[11] Patent Number: 5,331,939

[45] Date of Patent: Jul. 26, 1994

[54] TRANSIENT FUELING COMPENSATION

[75] Inventors: Douglas E. Trombley, Grosse Pointe; Kenneth J. Buslepp, Shelby Township, Macomb County; William C. Albertson, Sterling Heights, all of Mich.

[73] Assignee: General Motors Corporation, Detroit, Mich.

[21] Appl. No.: 69,334

[22] Filed: Jun. 1, 1993

[51] Int. Cl.[5] ..... F02M 67/02

[52] U.S. Cl. ..... 123/533

[58] Field of Search ..... 123/478, 480, 492, 531, 123/533

[56] References Cited

U.S. PATENT DOCUMENTS

| | | | |
|---|---|---|---|
| 4,996,960 | 3/1991 | Nishiyama et al. | 123/492 |
| 5,020,504 | 6/1991 | Morikawa | 123/531 |
| 5,027,773 | 7/1991 | Shimomura et al. | 123/492 |
| 5,031,594 | 7/1991 | Morikawa | 123/533 |
| 5,050,084 | 9/1991 | Nakaniwa | 123/492 |
| 5,051,909 | 9/1991 | Gomez et al. | 364/431.05 |
| 5,127,383 | 7/1992 | Wild | 123/492 |
| 5,150,692 | 9/1992 | Trombley et al. | 123/533 |
| 5,161,510 | 11/1992 | Yamada | 123/531 |

*Primary Examiner*—Willis R. Wolfe

*Attorney, Agent, or Firm*—Michael J. Bridges

[57] ABSTRACT

Air/fuel ratio control compensation is applied to an internal combustion engine having pneumatic fuel injection, wherein an engine operating condition is determined and appropriate compensation provided to the fuel command when an operating condition is sensed in which a significant fuel residue remains in the pneumatic injector after the end of an injection period.

5 Claims, 3 Drawing Sheets

TRANSIENT FUELING COMPENSATION

FIELD OF THE INVENTION

This invention relates to internal combustion engine control and, more specifically, to internal combustion engine inlet air and fuel compensation for improved engine air/fuel ratio control.

BACKGROUND OF THE INVENTION

It is generally known to apply pneumatic direct fuel injection systems to internal combustion engines. In such systems, fuel is metered for a controlled period of time into the body of an injector a short period of time before the injector opens. High pressure air is provided to the injector such that when the injector opens, the fuel is atomized and blasted into an engine combustion chamber for a controlled period of time after which the injector closes.

In such systems, fuel hangup may occur, wherein a portion of the quantity of fuel metered into the injector remains in the injector after the injector closes. This portion of fuel augments the quantity of fuel available in the injector at the start of the next injection event into the combustion chamber. A deviation away from a desired fueling rate may result from fuel hangup, driving the actual air/fuel ratio blasted into the combustion chamber away from a desired air/fuel ratio, which may degrade engine performance and may increase levels of pollutants emitted by the engine.

During extended periods of steady state engine operation in which the desired fueling rate will not change significantly, fuel hangup may not significantly contribute to deviations away from a desired fueling rate, as the amount of fuel hangup does not substantially vary from injection to injection, and thus a substantially constant quantity of fuel is passed to the combustion chamber during each air injection event. However, during transient maneuvers in which the desired fueling rate changes rapidly, fuel hangup may cause a significant deviation from the desired fueling rate throughout the maneuver.

Accordingly, what is needed is fueling rate compensation for the effects of fuel hangup in pneumatic direct fuel injection systems, especially during transient maneuvers.

SUMMARY OF THE INVENTION

The present invention addresses the abovedescribed need by providing compensation for the effects of fuel hangup in a pneumatic direct fuel injection system for an internal combustion engine.

Specifically, when an engine operating condition is sensed in which fuel hangup typically perturbs the actual fueling rate away from a commanded fueling rate, fuel hangup compensation is provided. A compensation factor is determined as a function of the engine operating level, and is applied as an adjustment to the commanded fueling rate to the engine.

The compensation factor may vary as a function of those engine operating conditions affecting the magnitude of the fuel hangup, such as the rate of change in the desired fueling rate and fuel injector temperature. Through application of the compensation factor to the commanded fuel rate, the difference between the desired fueling rate and the actual fueling rate is driven toward zero, furthering conventional engine control goals.

BRIEF DESCRIPTION OF THE DRAWINGS

The invention may be best understood by reference to the following preferred embodiment and to the drawings in which.

DESCRIPTION OF THE PREFERRED EMBODIMENT

Figure 1:
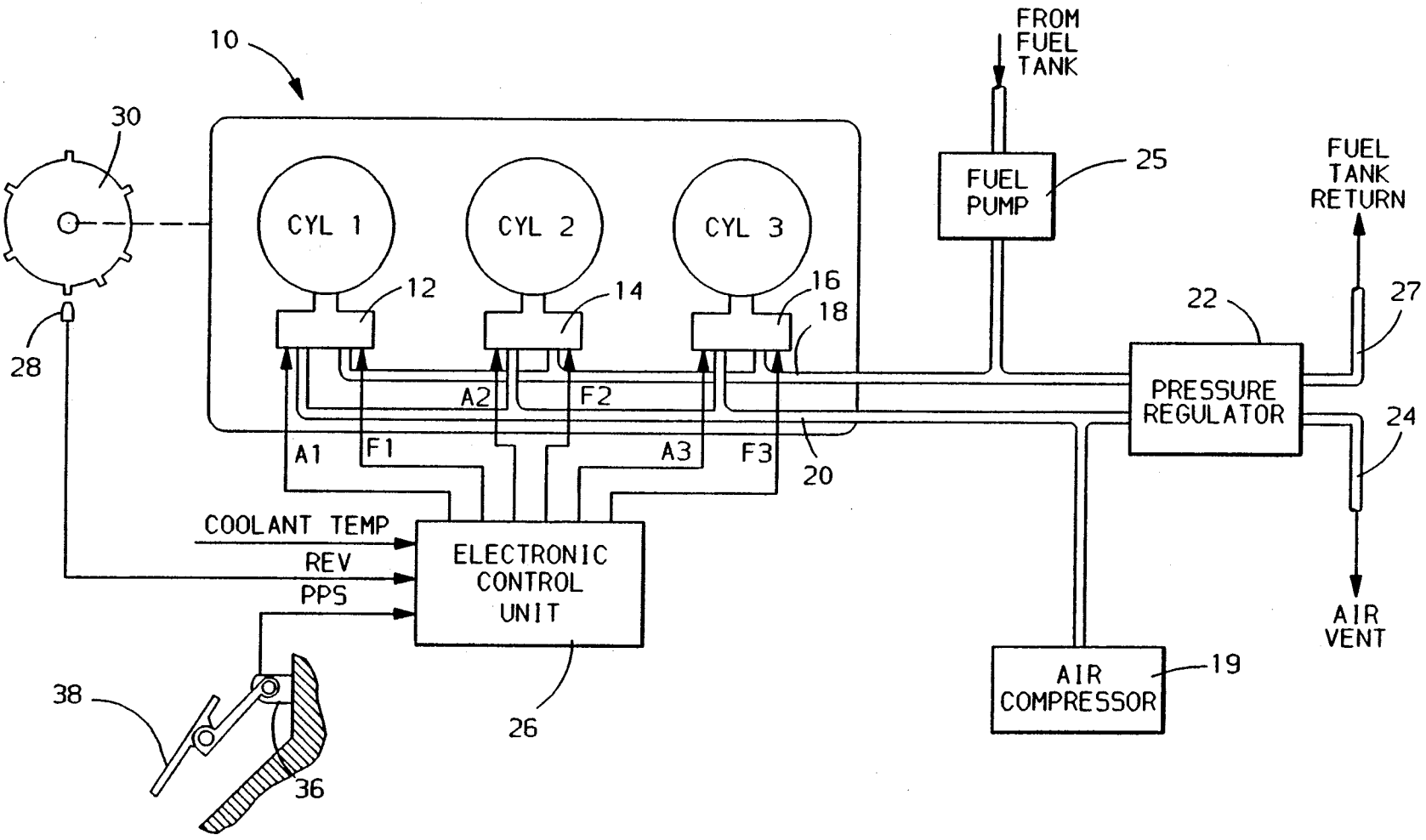
FIG. 1 is a general diagram of hardware used in a preferred embodiment of this invention.

Referring to FIG. 1, a multicylinder internal combustion engine 10 is shown, having cylinders CYL 1, CYL 2, and CYL 3. Each cylinder is directly fueled by a conventional pneumatic fuel injection system including dedicated selectively operable, solenoid actuated fuel injectors 12, 14, and 16, with a fuel conduit 18 and an air conduit 20 for delivering pressurized fuel and air to the injectors.

An air supply, such as a conventional air compressor 19 driven by the engine 10 provides pressurized air to the air conduit 20. Pressurized fuel is delivered to injectors 12, 14, and 16 through fuel conduit 18 by the action of fuel pump 25 which draws fuel from a fuel tank (not shown).

Conventional reference type fuel/air pressure regulator 22 regulates the maximum pressure of fuel in fuel conduit 18 and the maximum pressure of air in air conduit 20. The regulator 22 is of the type commonly used in pneumatic fuel injection systems for maintaining a fixed differential pressure between the fuel and air in the respective conduits. The air pressure in the regulator 22 is regulated at a predetermined air pressure above atmospheric pressure wherein the regulator in a conventional fashion vents excess air from the air conduit 20 through conduit 24 to the engine evaporative canister (not shown) or to the engine intake manifold (not shown) when the air pressure in conduit 20 exceeds the predetermined air pressure.

The pressure of fuel in conduit 18 is likewise regulated by pressure regulator 22 to a predetermined fuel pressure which is set a predetermined offset above the predetermined air pressure. When the fuel pressure in conduit 18 exceeds the predetermined fuel pressure, the pressure regulator 22 vents fuel through conduit 27 back to the fuel tank (not shown) to relieve the excess pressure. In the preferred embodiment, the predetermined air pressure may be set as 550 kPa above atmospheric pressure and the predetermined fuel pressure be set at 70 kPa above that of the air pressure, or approximately 620 kPa above atmospheric pressure.

A toothed wheel 30 rotates with the engine crankshaft (not shown). A conventional variable reluctance sensor 28 is provided in position to sense passage of the teeth on the wheel 30 and communicate such passage as a signal REV to electronic control unit ECU 26. In a manner well-known in the art of engine control, the ECU receives such information on tooth passage and converts the information into engine speed RPM, and relative engine position.

An accelerator pedal 38 receives an operator commanded engine operating point as a displacement of the pedal away from a rest position, the displacement being transduced into pedal position PPS by a conventional pedal position sensor 36, and communicated to ECU 26 for use in engine control in accord with generally known control practices. A conventional coolant temperature sensor (not shown) provides a signal COOLANT TEMP, indicative of engine coolant temperature, to ECU 26.

The electronic control unit ECU 26 may be a conventional single chip microcontroller, which processes generally known operating condition input signals, such as REV, PPS, and COOLANT TEMP, and communicates appropriate engine control commands to various conventional actuators in accord with generally understood principles of engine control.

In the conventional pneumatic direct fuel injection system of this embodiment, the ECU 26 periodically determines a desired fuel per cylinder value in the form of a desired fuel injection period and a desired air injection period. The ECU 26 then generates pulse signals F1–F3 and A1–A3 to be issued to individual respective fuel and air solenoids (not shown) within fuel injectors 12, 14, and 16, at appropriate rotational positions of the engine as determined from the REV input signal.

The width of the output pulses F1–F3 determines the metered quantity of fuel that is deposited in a holding chamber within each of the respective fuel injectors 12, 14 and 16. The air pulses A1–A3 are timed by the ECU 26 to open each nozzle (not shown) of the respective fuel injectors 12, 14, and 16, to initiate the start of cylinder fuel injection a predetermined period of time, typically one to three milliseconds, after the fuel has been injected into the holding chamber. The width of each air pulse A1–A3, commonly referred to as the cylinder injection period, determines the length of time that each injector nozzle remains open.

During the cylinder injection period, pressurized air from the air supply enters an injector and drives the metered fuel from its holding chamber through the open nozzle and directly into the associated engine cylinder. The pressurized air serves to atomize the fuel for clean combustion and enables the fuel to be injected directly into a combustion chamber against opposing cylinder combustion pressure.

Figure 2:
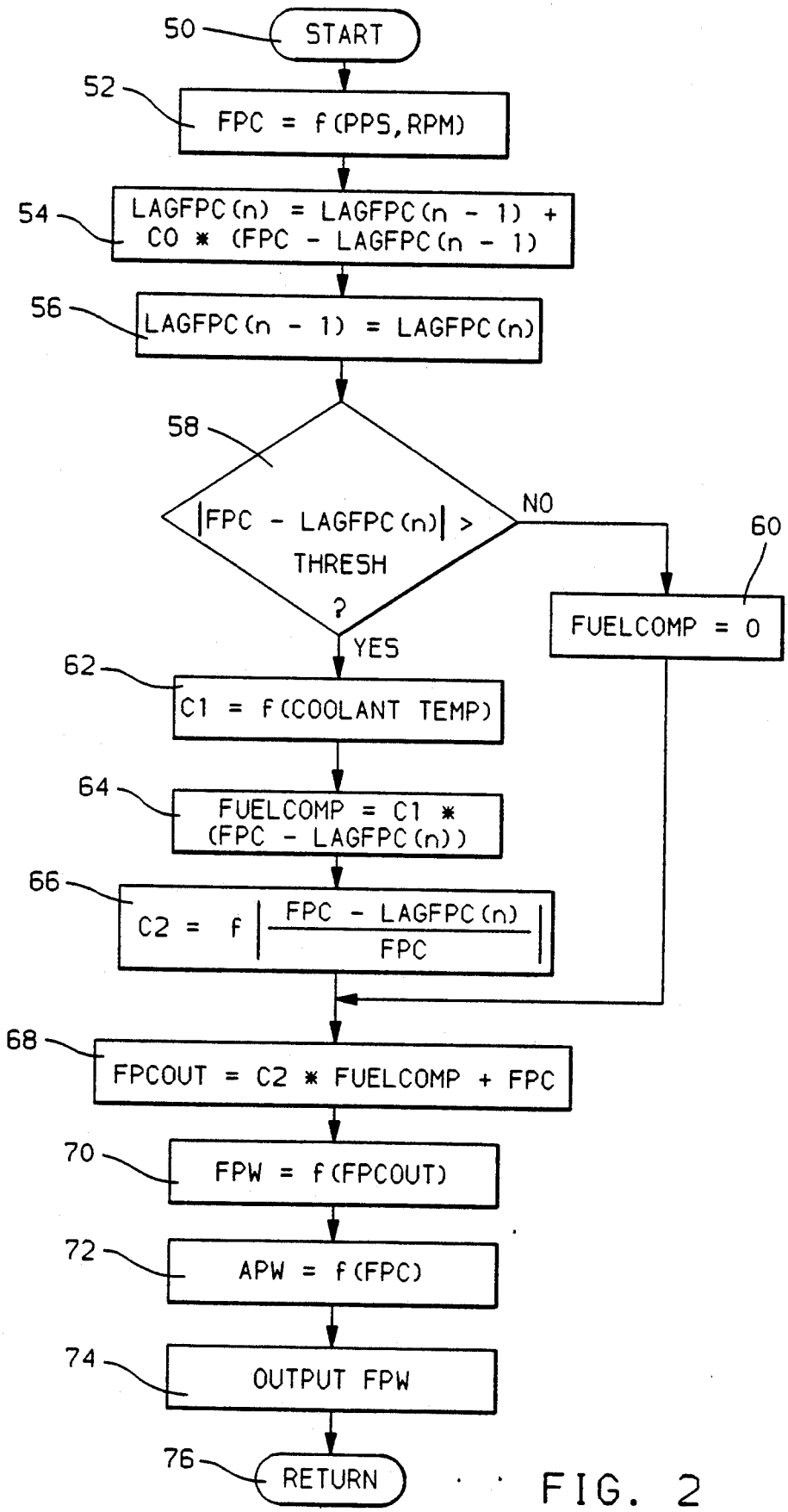
FIG. 2 is a computer flow diagram illustrating the steps used to carry out the principles of this invention in accord with the preferred embodiment and with the hardware of FIG. 1.

The duration of the fuel commands F1–F3 and of the air commands A1–A3 are determined in this embodiment as described in FIG. 2. The series of steps illustrated in FIG. 2 may be stored in nonvolatile memory of ECU 26 (FIG. 1) as a series of computer instructions to be periodically executed by the ECU 26 in a manner generally understood in engine control. In this embodiment, the routine consisting of the steps of FIG. 2 is executed when fuel and air commands to the engine 10 are to be updated, such as approximately every ten milliseconds while the ECU 26 is operating.

The routine of FIG. 2 starts at step 50 and moves to step 52 to determine a desired fuel per cylinder command FPC in a conventional manner as a function of engine speed RPM and accelerator pedal position PPS. FPC may be referenced from a look-up table in ECU 26 memory having PPS and RPM as look-up parameters and having entries calibrated to provide a fuel delivery quantity consistent with conventional engine control goals.

After referencing an appropriate FPC value, the routine moves to step 54 to pass FPC through a simple lag filter, according to the following equation $$LAGFPC(n) = LAGFPC(n-1) + C0 * (FPC - LAGFPC(n-1))$$

in which LAGFPC(n) is a present filtered FPC command, LAGFPC(n−1) is initialized to zero at engine startup and is the filtered FPC command from the most recent prior iteration of the routine of FIG. 2, and C0 is a calibration constant, set to 0.375 in this embodiment, to weight the lag in the filter.

The magnitude of LAGFPC(n) thus lags behind the magnitude of FPC by an amount that varies in proportion to the rate of change in FPC. In this embodiment, LAGFPC(n) is generated for use in analysis of the rate of change in FPC, wherein the deviation between FPC and LAGFPC(n) indicates the nature if the present engine maneuver. If the magnitude of the deviation exceeds a calibrated threshold magnitude, a transient maneuver is diagnosed and fuel hangup compensation is provided, as will be described.

Returning to FIG. 2, after calculating LAGFPC(n) at step 54, the routine updates LAGFPC(n−1) with the current LAGFPC(n) at step 56, for use in the next iteration of the routine of FIG. 2. The routine then determines the magnitude of the difference between FPC and LAGFPC(n) and compares that magnitude to a predetermined calibration threshold THRESH, at step 58. In this embodiment, THRESH is calibrated as 4 milligrams of fuel, as it has been determined that in the engine application of this embodiment, a transient maneuver requiring fuel hangup compensation is present if the lag filtered fuel per cylinder command LAGFPC(n) with a lag coefficient C0 of 0.375 deviates from the raw fuel per cylinder FPC command by more than four milligrams. Such a determination was made by monitoring the rate of change in commanded fuel per cylinder to determine the minimum change that would create significant fueling inaccuracies from fuel hangup, and reflecting the found minimum rate of change through the lag filter described at step 54.

Returning to step 58, if the magnitude of the difference does not exceed THRESH, then no fuel hangup compensation is necessary for the present change in commanded fuel per cylinder, and the routine moves to step 60, to clear FUELCOMP, a fuel hangup compensation factor, to eliminate fuel hangup compensation for this iteration of the routine of FIG. 2. The routine then moves to step 68, to be described.

Alternatively at step 58, if the magnitude of the difference does exceed THRESH, the routine prepares compensation values for the fuel per cylinder command at steps 62–66. First, at step 62, a value C1 is determined as a function of present engine coolant temperature COOLANT TEMP. Generally, fuel injector temperature has been determined to affect fuel hangup magnitude. A cold injection path increases the potential for condensation of fuel metered into the injectors of a typical conventional pneumatic fuel injection system, increasing fuel hangup potential.

Sensor information available for general engine control may be used to estimate injector temperature with a reasonable degree of accuracy, and the degree of fuel hangup compensation adjusted accordingly. For example, in this embodiment, sensed coolant temperature may be used to estimate injector temperature. In an alternative embodiment, the difference between coolant temperature at engine startup and that when the engine was last turned off may be used to estimate injector temperature. Alternatively, injector temperature may be measured directly.

Returning to FIG. 2, the estimate of injector temperature, such as coolant temperature in this embodiment, is used to determine C1, a coefficient used in computing the magnitude of a compensation quantity, to be described. C1 values may be stored in non-volatile memory of electronic control unit ECU 26 (FIG. 1) in a look-up table, and may be referenced therefrom using a lookup parameter of sensed engine coolant temperature COOLANT TEMP.

Figure 3:
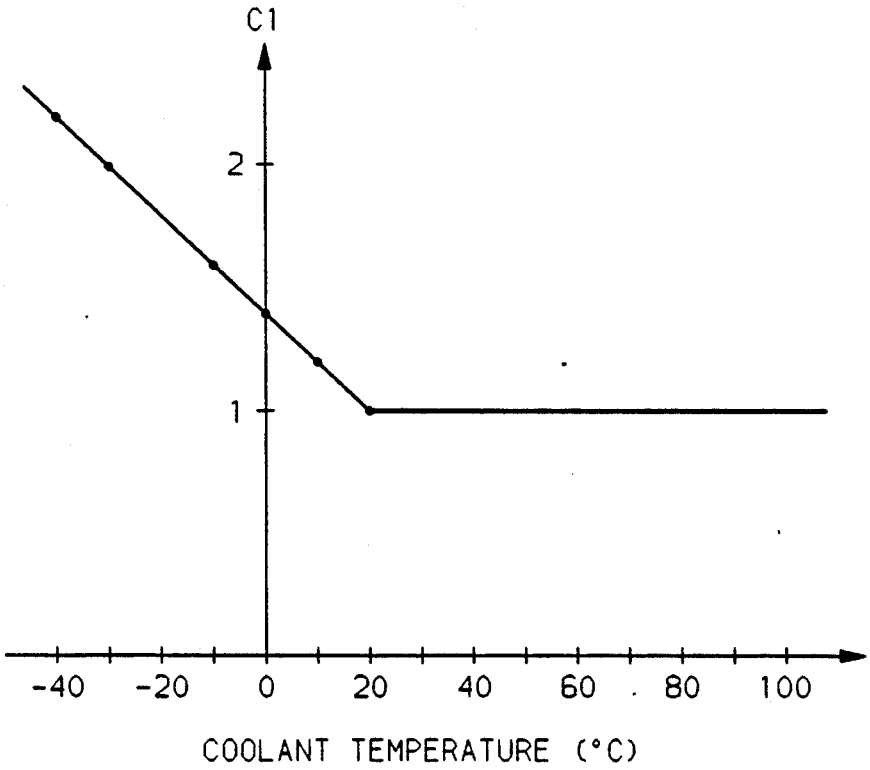
FIGS. 3 and 4 illustrate relationships between control inputs and calibration constants used in the preferred embodiment of this invention.

The relationship between C1 and COOLANT TEMP should be calibrated by measuring or estimating any variation in a fuel hangup quantity with coolant temperature. Fuel hangup variation may be estimated during transient engine maneuvers by monitoring perturbations in a delivered fuel quantity from a commanded fuel quantity at varying injector temperatures. FIG. 3 illustrates the result of such a calibration, showing a typical relationship between C1 and coolant temperature. At coolant temperature above twenty degrees Celsius, C1 is calibrated as unity, while C1 increases approximately linearly with coolant temperature as coolant temperature decreases below twenty degrees Celsius.

After determining an appropriate value to be assigned to C1 at step 62, the routine moves to step 64 to calculate FUELCOMP, the fuel compensation value as follows $$FUELCOMP = C1 * (FPC - LAGFPC(n)).$$

The routine next determines the amount of weight with which FUELCOMP will be applied to FPC, by determining a weighting constant C2 as a function of the difference between FPC and LAGFPC(n) at step 66. C2 is provided to tailor the fuel compensation term FUELCOMP for the type of transient maneuver encountered. For rapid changes in commanded fuel, indicated by a large deviation between FPC and LAGFPC(n), desirable improvements in engine response are provided by increasing commanded fuel, by increasing C2. Such response improvements may not be required for less rapid changes in commanded fuel, as the lag between commanded engine operating point and actual engine operating point may not be significant in such a maneuver.

Figure 4:
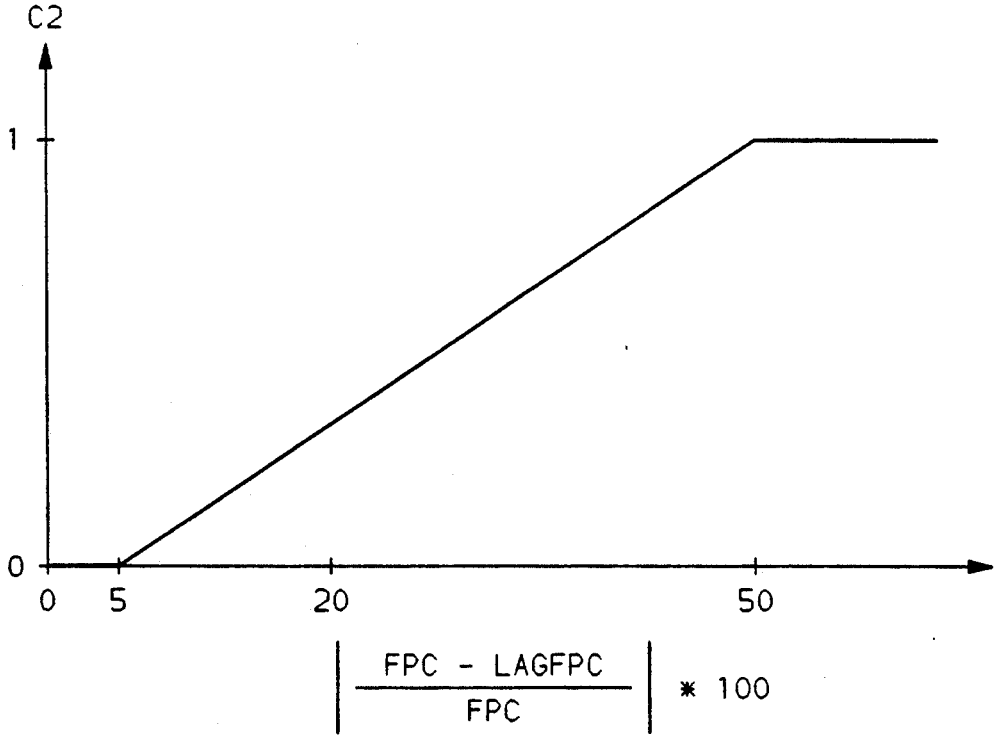

Accordingly, and with consideration to engine emissions performance, increases in transient fueling through increases in C2 are only provided when significant benefit may result therefrom, which is during heavy transients. FIG. 4 illustrates a relationship between C2 and the degree of transient as reflected in the percent difference in magnitude between FPC and LAGFPC(n). For extremely heavy transients, indicated in this embodiment by FPC exceeding LAGFPC(n) by fifty percent or greater, a maximum C2 of unity is applied in the compensation of this embodiment. For lighter transients, C2 decreases approximately linearly with percent difference between FPC and LAGFPC(n), finally reaching zero near five percent change. The relationship between the degree of transient being compensated and the magnitude of C2 may be calibrated consistent with the above-described performance and emissions considerations, and stored in a conventional look-up table in non-volatile memory of the ECU 26 (FIG. 1).

After determining C2 at step 66, the routine moves to step 68, to calculate an adjusted commanded fuel per cylinder quantity FPCOUT according to the following equation $$FPCOUT = C2 * FUELCOMP + FPC$$

to adjust the commanded fuel per cylinder FPC by the compensation factor FUELCOMP weighted by C2, as described. For light transients, FPCOUT will be equal to or close in magnitude to FPC. For heavy transients however, the full compensating effect of FUELCOMP will be reflected through C2 to FPCOUT, to adjust fueling as necessary in accord with this invention.

Next, a fuel injection solenoid pulsewidth FPW is determined at step 70 from FPCOUT by reference to a look-up table stored in non-volatile ECU memory. The table entries should be calibrated as the fuel injector pulse width duration needed for the physical system to which this routine is applied to meter the desired quantity of fuel FPCOUT to the holding chambers of the engine 10 (FIG. 1), as described.

After computing the desired fuel injection pulse width FPW at step 70, the routine moves to step 72 to determine a value for the desired air pulse width APW, which represents the desired injection duration during which the high pressure air blasts fuel from the holding chamber into an engine combustion chamber. APW may be determined from a look-up table stored in non-volatile memory of ECU 26, as a function of the FPC determined at the described step 52. The entries in the APW look-up table are intended to be those found during conventional engine calibration to provide beneficial engine fuel economy, output power, and exhaust pollutant levels, in a manner generally understood in the engine control art. Typical table values for APW range from three to six milliseconds.

It should be pointed out that APW is not determined from the compensated fuel command FPW, as APW must be consistent with FPC, the desired quantity of fuel ultimately metered to the engine, and need not be consistent with FPW, which is merely the amount of fuel commanded into the holding chamber, as described. Likewise, any further calculations that may be necessary to carry out the engine control in accord with this embodiment and not specifically described herein, such as conventional spark, fuel and air timing commands, should be based on FPC and not on FPW. As such, the compensation provided in accord with this invention provides a desirable adjustment to the fuel quantity entering the holding chambers of injectors 12, 14, and 16, but not the desired quantity of fuel entering the engine 10.

Returning to FIG. 2, after computing the desired air pulse width APW at step 72, the routine moves to step 74, to output the computed fuel pulse width FPW to an appropriate fuel solenoid as dictated by the rotational position of the engine 10 within an engine cycle. The APW command will be issued at a later time, typically one to three milliseconds after the issuance of FPW at step 74. The time of the air injection may be computed in accord with general engine control principles, and may be issued to the air solenoids of injectors 12, 14, and 16 by operation of ECU 26 (FIG. 1) or by operation of conventional electronic circuitry. After communicating the FPW command to the appropriate solenoid at step 74, the routine moves to step 76 to return to any activity that was taking place prior to the start of the present iteration of the routine of FIG. 2. As described, the routine of FIG. 2 will be periodically re-executed in the manner described when fuel and air commands are to be updated.

The preferred embodiment for the purpose of explaining this invention is not intended to limit or restrict the invention since many modifications may be made through the exercise of skill in the art without departing from the scope of the invention.

The embodiments of the invention in which a property or privilege is claimed are described as follows:

1. A method for compensating a fuel command issued to a fuel injector of an internal combustion engine having pneumatic fuel injection wherein pressurized air is provided to inject a fuel quantity held within the fuel injector into the engine while the injector is opened during a cylinder injection period, comprising the steps of:

generating the fuel command;

sensing a rate of change in the fuel command;

determining a compensation value as a predetermined function of the sensed rate of change; and calculating a compensated fuel command as a predetermined function of the generated fuel command and of the compensation value.

2. The method of claim 1, further comprising the steps of:

sensing a predetermined engine condition indicative of fuel injector temperature; and adjusting the compensation value as a predetermined function of the sensed predetermined engine condition.

3. The method of claim 2, wherein the predetermined engine condition is engine coolant temperature.

4. A method for compensating a commanded fueling rate to an internal combustion engine having pneumatic fuel injection wherein pressurized air drives a quantity of fuel into the engine, comprising the steps of:

generating a fuel command;

sensing a transient maneuver of the engine, by (a) determining a rate of change in the fuel command, (b) comparing the determined rate of change to a predetermined threshold rate of change, and (c) sensing a transient maneuver of the engine when the determined rate of change exceeds the threshold rate of change; and compensating the generated fuel command when a transient maneuver is sensed, comprising the steps of (a) sensing a predetermined engine operating condition, (b) determining a compensation factor as a predetermined function of the sensed predetermined engine operating condition, and (c) adjusting the generated fuel command by the compensation factor.

5. The method of claim 4, wherein the compensating step further comprises the steps of:

estimating fuel injector temperature; and adjusting the compensation factor as a predetermined function of the estimated temperature.

* * * * *